United States Patent [19]

Kwasnitza

[11] Patent Number: 4,784,559

[45] Date of Patent: Nov. 15, 1988

[54] APPARATUS FOR SUBDIVIDING PILES OF SUPERIMPOSED STACKS OF PAPER SHEETS AND THE LIKE

[75] Inventor: Hans-Dieter Kwasnitza, Neuffen, Fed. Rep. of Germany

[73] Assignee: Womako Maschinenkonstruktionen GmbH, Nürtingen, Fed. Rep. of Germany

[21] Appl. No.: 25,817

[22] Filed: Mar. 13, 1987

[30] Foreign Application Priority Data

Mar. 15, 1986 [DE] Fed. Rep. of Germany ..... 3608750

[51] Int. Cl.[4] ..... B65H 3/50; B65H 33/02

[52] U.S. Cl. ..... 414/114; 414/119; 414/907

[58] Field of Search ..... 414/114, 115, 119, 907

[56] References Cited

U.S. PATENT DOCUMENTS

| | | | |
|---|---|---|---|
| 3,206,042 | 9/1965 | Peterson | 414/114 |
| 4,313,703 | 2/1982 | Fabrig | 414/115 |
| 4,551,053 | 11/1985 | Ishibashi | 414/114 |
| 4,623,292 | 11/1986 | Suzuki et al. | 414/114 |
| 4,662,816 | 5/1987 | Fabrig | 414/115 X |

FOREIGN PATENT DOCUMENTS

| | | | |
|---|---|---|---|
| 71864 | 2/1983 | European Pat. Off. | 414/114 |
| 2753301 | 12/1978 | Fed. Rep. of Germany | 414/114 |
| 2313294 | 12/1976 | France | 414/114 |
| 2090815 | 7/1982 | United Kingdom | 414/114 |

*Primary Examiner*—Leslie J. Paperner

*Attorney, Agent, or Firm*—Peter K. Kontler

[57] ABSTRACT

Apparatus for lifting successive topmost stacks of large paper sheets and the panels beneath such stacks off a pile of superimposed stacks and panels has one or more separating units each employing a roller which is caused to bear upon the topmost sheet of the topmost stack of the pile and a sword which is aligned with or is disposed at a level slightly below the topmost panel of the pile and is caused to penetrate into the pile so as to lift the topmost stack with the topmost panel preparatory to automatic shifting of the lifted stack and panel sideways into a processing machine. The distance between the lowermost portion of the roller and the plane of the sword is adjustable to permit for subdivision of piles having thicker or thinner stacks. Any sheets which are lifted with a panel and belong to the stack below the lifted panel are stripped off the lifted panel by a continuously driven friction wheel which enters the gap that is formed by the sword. A hold-down device is employed to press upon the stack below the gap during transfer of the lifted stack and panel into the processing machine.

18 Claims, 11 Drawing Sheets

APPARATUS FOR SUBDIVIDING PILES OF SUPERIMPOSED STACKS OF PAPER SHEETS AND THE LIKE

CROSS-REFERENCE TO RELATED CASE

The apparatus of the present invention constitutes an improvement over and a further development of the apparatus which is disclosed in commonly owned U.S. Pat. No. 4,313,703 granted Feb. 2, 1982 to Paul Fabrig and in the commonly owned copending patent application Ser. No. 889,608 filed July 28, 1986 by Paul Fabrig, now U.S. Pat. No. 4,662,816. The disclosures of the patent and patent application of Fabrig are incorporated herein by reference.

BACKGROUND OF THE INVENTION

The present invention relates to improvements in apparatus for manipulating stacks of paper sheets and the like, and more particularly to improvements in apparatus for manipulating piles of superimposed stacks of sheets wherein neighboring stacks are separated from each other by panels of paperboard, cardboard, plastic material or the like. Still more particularly, the invention relates to improvements in apparatus for transferring successive stacks of a pile of superimposed stacks into a machine or apparatus wherein the stacks are converted into writing pads, steno pads, exercise books or other types of stationery products.

It is customary to assemble large sheets of paper or the like into stacks which are superimposed upon each other to form piles wherein each stack rests on a relatively stiff or reasonably still panel of paperboard or the like. The thickness or height of a discrete stack cannot exceed a maximum thickness which is still acceptable for further processing of the stack in a machine for making note books, steno pads, exercise books and like stationery products. In heretofore known production lines for pads or the like, such large stacks are lifted off a pile of superimposed stacks by hand and are introduced into a production line wherein successive stacks are automatically transported, severed and otherwise treated to convert them into pads or other types of stationery products. The stacks are delivered to the feeding station for individual stacks in the form of piles of superimposed stacks, and each stack rests on a discrete panel which is normally converted into the rear covers or backs of several pads, i.e., into the rear covers of those pads which are obtained by subdividing the respective stack into a plurality of smaller stacks and by bonding, wiring, stapling, sewing or otherwise securing the sheets of each smaller stack to each other.

The locus of feeding of discrete stacks of large sheets into an automatic production line constitutes a bottleneck because it is not always possible to manually feed successive stacks at the required rate. A serious problem is that of rapidly separating the topmost stack and the panel beneath the topmost stack from the next-to-the-topmost stack of a pile of superimposed stacks.

British Pat. No. 2 090 815 discloses a method according to which the panels between successive stacks of a pile of such stacks are offset relative to the neighboring sheets so that a portion of each panel projects from the pile. The method comprises the step of applying suction to the projecting portion of the topmost panel in the pile so that the panel is lifted and defines with the sheet immediately below it a gap which can receive a sword-like separating element serving to further separate the topmost stack and the panel below it from the remainder of the pile. A drawback of such proposal is that the projecting portions of the panels are wasted as well as that it is not always possible to readily lift the panels and the stacks thereabove by suction.

German Offenlegungsschrift No. 27 53 301 proposes to ascertain the number of sheets to be lifted off a pile, either by selecting the level of a separating finger which is to penetrate into the edge face of a pile or by actually counting the number of sheets from the topmost sheet down. Once a selected number of sheets has been counted, the separating finger is caused to penetrate beneath the last-counted sheet and provides a gap between the thus obtained topmost stack and the stack therebelow. This is a time-consuming and cumbersome procedure.

OBJECTS AND SUMMARY OF THE INVENTION

An object of the invention is to provide a novel and improved method of reliably subdividing a pile of superimposed stacks of paper sheets or the like into individual stacks without the need to actually count the sheets and without necessitating the utilization of panels which project from the pile.

Another object of the invention is to provide a fully automated apparatus which can rapidly and reliably subdivide a pile of superimposed stacks and panels into discrete stacks and associated panels in a time-saving operation and in an optimum way for admission into a processing machine, such as a machine for making exercise pads or the like.

A further object of the invention is to provide a novel and improved method of breaking up a pile of stacked large paper sheets and the like into discrete smaller piles or stacks at a frequency which is needed to satisfy the requirements of automatic machines for the making of pads and similar stationery products.

An additional object of the invention is to provide the apparatus with novel and improved means for lifting and otherwise moving successive topmost stacks relative to the neighboring stacks of a pile of large paper sheets or the like.

Still another object of the invention is to provide the apparatus with novel and improved means for removing from separated stacks one or more sheets which belong to the next-following stacks but happen to be intentionally or accidentally separated with the topmost stack.

An additional object of the invention is to provide novel and improved means for driving the moving parts of the above outlined apparatus.

The apparatus of the present invention is designed to subdivide a pile of superimposed stacks of sheets wherein each stack has a predetermined thickness and rests on a planar bottom panel of paperboard or the like. The apparatus comprises separating means including at least one separating unit having a device (e.g., a roller or wheel) for applying to the pile mechanical pressure from above (i.e., for pressing against the upper side of the topmost sheet of the topmost stack of the pile), a sharp-edged sword or an analogous separating element which is disposed in a plane parallel to the planes of the panels in the pile and serves to penetrate into the pile at a level below the pressure applying device, and distancing means for maintaining the pressure applying device and the separating element in spaced-apart positions at a mutual distance which at least matches the predetermined thickness of a stack. Means is preferably provided to adjust the distancing means so as to vary the distance between the pressure applying device and the separating element and to thus enhance the versatility of the apparatus.

The apparatus further comprises means for moving the pressure applying device in a substantially vertical plane toward engagement with the topmost stack of the pile and for moving the separating element in a substantially horizontal plane into the panel beneath the topmost stack of the pile. The distancing means preferably includes means for maintaining the separating element in the plane of the panel beneath the topmost stack of the pile when the pressure applying device abuts the topmost sheet of the topmost stack of the pile.

The separating unit can further comprise means for stripping surplus sheets off the underside of the panel beneath the topmost stack of the pile if and when the separating element penetrates into the pile beneath the panel which is disposed immediately below the topmost stack. The stripping means can comprise one or more continuously driven friction rollers or wheels.

The separating element is arranged to form a gap between the topmost panel of the pile (i.e., the panel beneath the topmost stack of the pile) and the stack therebelow, and the separating unit preferably further comprises a hold-down device and means for moving the hold-down device into the gap and against the topmost sheet of the next-to-the-topmost stack of the pile upon penetration of the separating element into the pile beneath the pressure applying device. The separating unit can also comprise means for shifting the separated topmost stack of the pile and the panel beneath such stack with reference to the next-to-the-topmost stack of the pile. A common support (e.g., a shaft) can be provided for the means to move the pressure applying device jointly with the separating element, for the means for moving the shifting means, for the means for moving the hold-down device and for the means for moving the means for stripping sheets off the underside of the panel which has been separated with the topmost stack. Each of the moving means can comprise a parallel motion (e.g., a four-link parallel motion). The drive means for the parallel motions can comprise a cyclically driven camshaft, a plurality of cams on the camshaft and follower means provided on the parallel motions and each arranged to track at least one of the cams.

The separating means can comprise a plurality of separating units (e.g., two discrete separating units) which are spaced apart from one another, and means for moving the pressure applying devices and the separating elements of the separating units up and down. Such means for moving up and down can comprise a discrete driver shaft for each separating unit, a cardan shaft whose end portions are articulately connected with the driver shafts, and a prime mover which is arranged to rotate one of these shafts, e.g., the cardan shaft. A common reciprocable carriage can be provided for the units of the separating means. Signal generating monitoring means can be provided on or otherwise associated with the parallel motion for the hold-down device of at least one separating unit to monitor the level of the respective unit, and the signals which are generated by the monitoring means can be used to control the movements of the means for moving the units up and down.

Additional monitoring means can be provided to monitor the pile for the presence of panels beneath the stacks.

A system of chain conveyors or other types of elevator conveyors can be used to move pallets with piles of stacks thereon along a predetermined path so as to lift a pile upon removal of a stack from its top.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
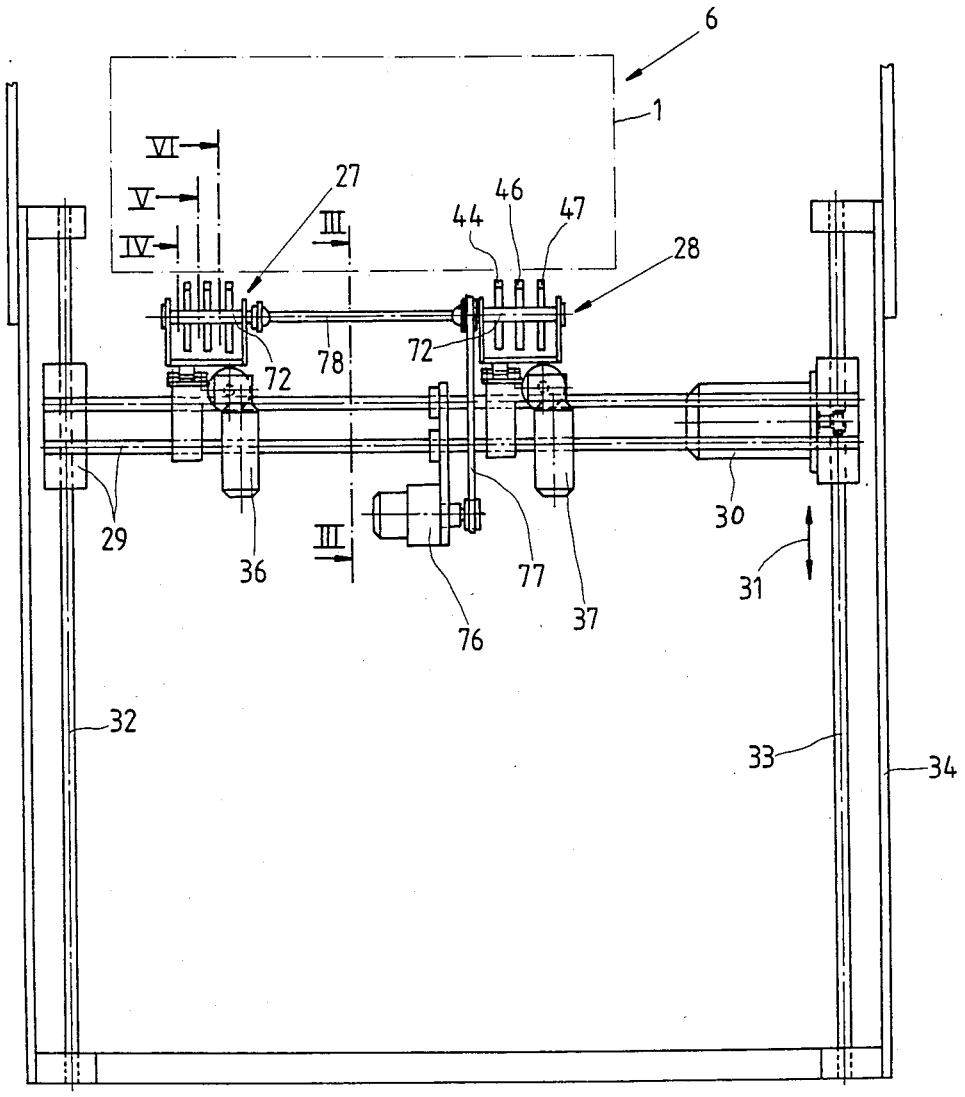
FIG. 1 is a schematic plan view of an apparatus which embodies one form of the invention and wherein the separating means comprises two identical separating units.
Figure 2:
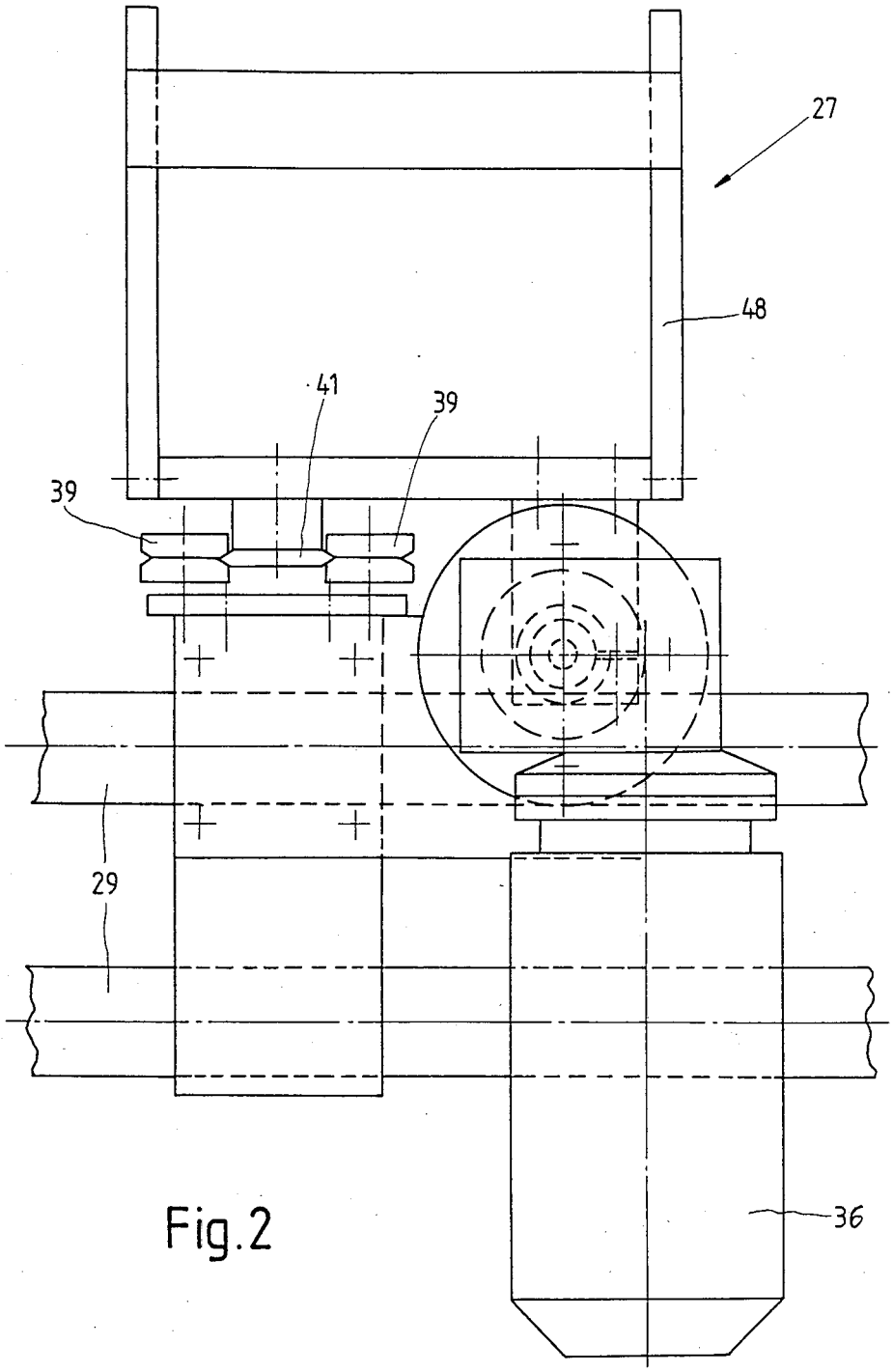
FIG. 2 is an enlarged plan view of one separating unit in the apparatus of FIG. 1.
Figure 4:
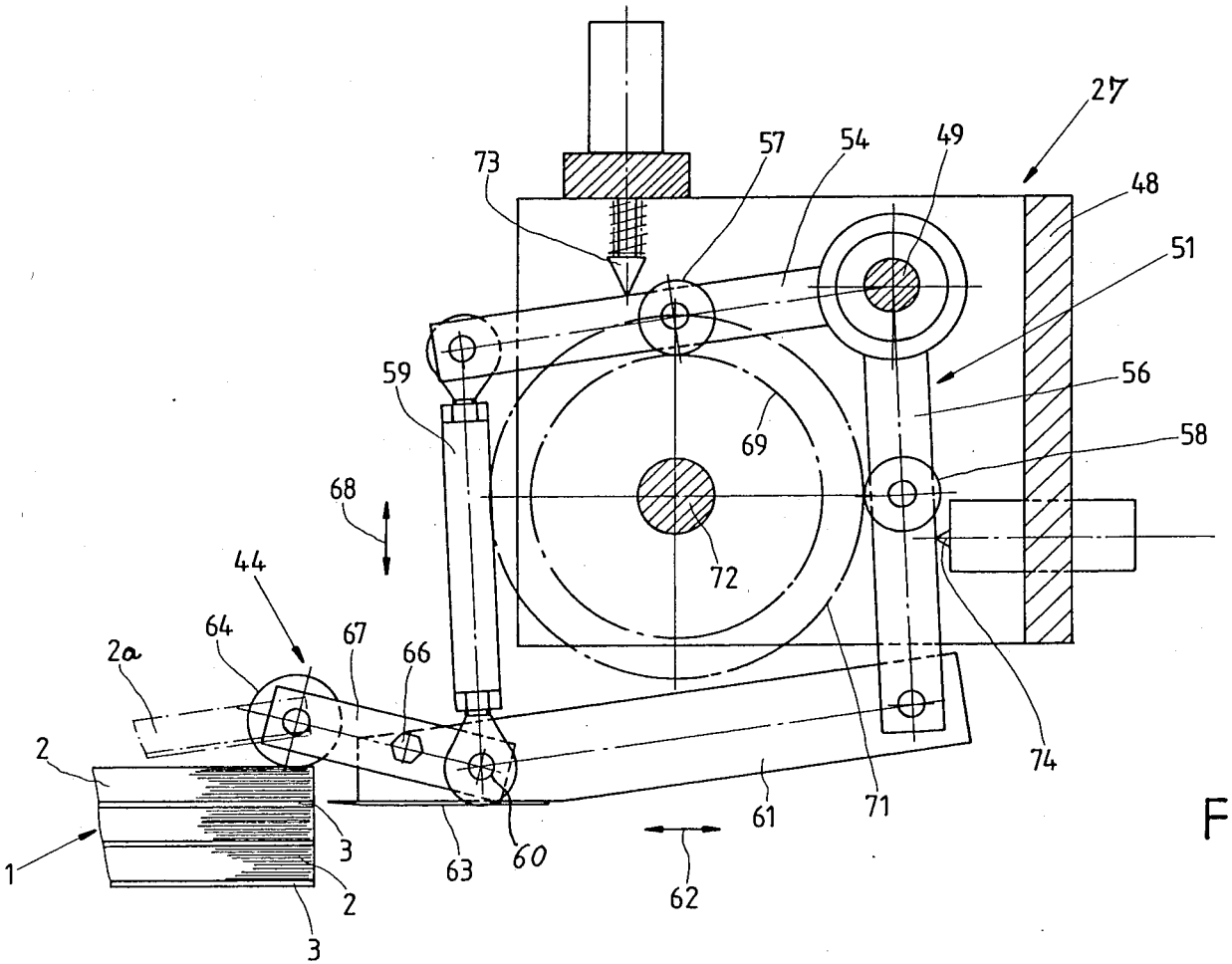
FIG. 4 is an enlarged fragmentary vertical sectional view as seen in the direction of arrows from the line IV of FIG. 1 and shows certain parts of the one separating unit in positions they assume immediately prior to penetration of the separating element into the pile.

Referring to FIGS. 1 and 4, there is shown a pile 1 of superimposed large paper stacks 2 each of which rests on a panel 3 of paperboard, plastic material or the like. The pile 1 is to be subdivided into discrete stacks 2 each of which continues to rest on a panel 3. The separated discrete stacks 2 are thereupon processed to yield a number of pads and the corresponding panels 3 are subdivided into sections which constitute or form part of the rear covers of the respective pads.

The pile 1 rests on a support in the form of a pallet 4 (FIGS. 9 and 10) which is delivered into the range of elevator conveyor means at a lower station 6 and is lifted stepwise, always upon removal of a stack 2 and a panel 3 from the top of the pile 1 thereon, toward an upper station 18. The end portions of the pallet 4 at the lower station 6 rest on the platforms 7,7' of two endless chain conveyors 8, 9 which are trained over sprocket wheels 11, 12, respectively. Two additional endless chain conveyors are shown at 13 and 14; the sprocket wheels therefor are respectively shown at 16 and 17. The conveyors 13 and 14 serve to transport shorter or smaller pallets.

When the last stack 2 of a pile 1 (together with the respective panel 3) is removed from a pallet 4, the thus emptied pallet (**4*a*) is moved upwardly to the station 18 while a loaded fresh pallet 4 (with a full-sized pile 1 thereon) enters the lower station 6. On its way toward the station 18, the empty pallet 4*a* advances past two pivotable pawls 19, 21 which are pivotably mounted on plate-like carriers 22, 23 and are biased by springs 24 which are free to pivot the pawls to the positions corresponding to that of the pawl 21 in FIG. 10 not later than when the pallet 4*a* enters the station 18. At such time, the top edge faces 26 of the pawls 19, 21 are located below the empty pallet 4*a*** and the latter comes to rest on the pawls preparatory to its withdrawal from the apparatus.

Other types of elevator conveyor means for pallets 4 or for otherwise configurated supports for piles 1 can be used with equal or similar advantage. All that counts is to ensure that the apparatus will embody or will cooperate with conveyor means which can deliver fresh piles 1 at the required rate and which can lift successive piles upon removal of successive stacks 2 (and corresponding panels 3) therefrom so that the topmost stack of a pile 1 will invariably assume an optimum position for separation from the remainder of the respective pile.

Figure 3:
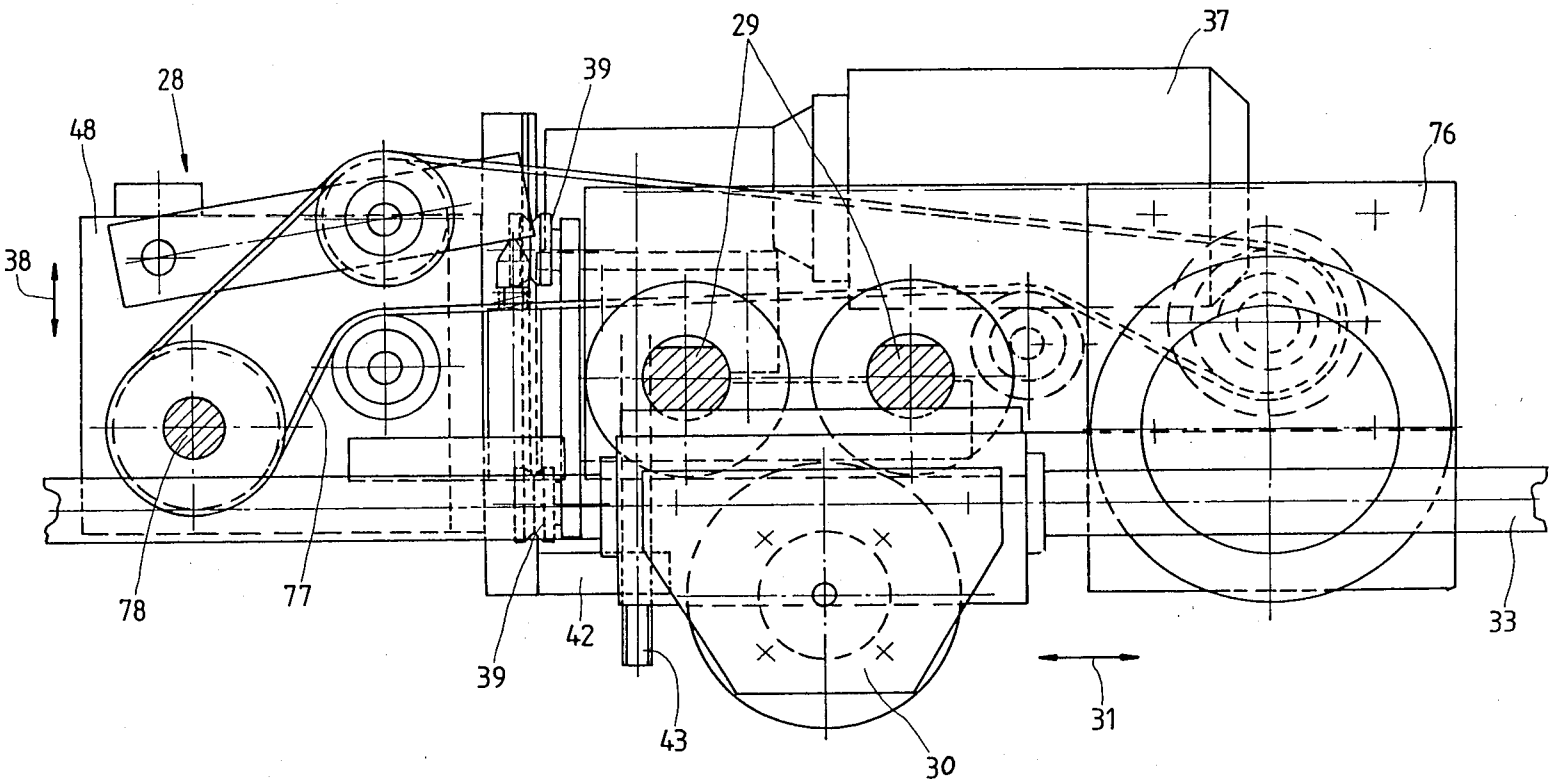
FIG. 3 is an enlarged fragmentary vertical sectional view as seen in the direction of arrows from the line III—III of FIG. 1 and shows the other separating unit in a side elevational view.

The stacks 2 of the piles 1 are assembled from superimposed large or very large sheets. Therefore, the apparatus preferably comprises a separating means which includes two discrete separating units 27 and 28 spaced apart from one another along one longitudinally extending vertical edge face of the pile 1 which is to be broken up into discrete stacks 2 and associated panels 3. This can be seen in FIG. 1 which shows that the units 27 and 28 are respectively adjacent the left-hand and right-hand ends of one longitudinally extending (front) edge face of the pile 1. In order to ensure that the stations 6 and 18 will remain readily accessible, the separating units 27 and 28 are preferably mounted on a common carriage 29 which is disposed at a level above the stations 6, 18 and is reciprocable along a horizontal path so as to move the units 27, 28 to optimum positions for engagement of their parts with the topmost stacks 2 and topmost panels 3 of the pile 1 which is supported by a pallet 4 on the chain conveyors 8, 9 and/or 13, 14. The carriage 29 is reciprocable along its horizontal path by a reversible prime mover 30 (e.g., an electric motor) in directions which are indicated by a double-headed arrow 31 (see also FIG. 3). The means for transmitting motion from the prime mover 30 to the carriage 29 includes toothed racks 32 and 33 which mate with pinions (not shown) on the carriage 29. The toothed racks 32 and 33 are mounted on a skeleton frame 34 of the apparatus. Discrete motors 36 and 37 are provided to move the respective separating units 27, 28 up and down (with reference to the carriage 29) so as to ensure that the units 27, 28 are disposed at optimum levels (depending on the thickness or height of stacks 2 in the pile 1 which is to be broken up into discrete stacks and associated panels 3). The motors 36 and 37 can move the separating units 27 and 28 jointly in directions which are indicated by a double-headed arrow 38 (FIG. 3). These motors can lower the separating units 27, 28 toward the topmost sheet of the topmost stack 2 in the pile 1 which is in the process of being subdivided. The guide means for the separating units 27 and 28 include upright rails 41 which are tracked by roller followers 39 of the respective separating units. The motors 36 and 37 drive the respective separating units 27 and 28 by way of feed screws 43 and nuts 42 which mate with the respective feed screws. Other types of means for transmitting motion between the motors 36 and 37 on the one hand and the separating units 27, 28 on the other hand can be used with equal or similar advantage.

The separating units 27 and 28 are preferably identical. Therefore, FIGS. 4 to 8 merely show the details of the separating unit 27. This unit comprises a separator 44, a hold-down device 46 and a shifting means or pusher 47. The separator 44, the hold-down device 46 and the pusher 47 are movable independently of each other during different stages of a stack-removing operation and, to this end, are pivotable about a common support in the form of a horizontal shaft 49 installed in a U-shaped frame 48. The means for moving the separator 44 includes a first parallel motion 51 (FIG. 4), the means for moving the hold-down device 46 comprises a second parallel motion 52 (FIG. 5), and the means for moving the pusher 47 includes a third parallel motion 53 (FIG. 6). The parallel motion 51 for the separator 44 comprises two links 54, 56 which are pivotably mounted on the shaft 49 and respectively carry roller followers 57, 58 which respectively track disc cams 69, 71 on a camshaft 72 which is parallel to the shaft 49. The links 57, 58 cooperate with two additional links 59, 61 to form therewith a jointed four-link mechanism which imparts predetermined movements to the separator 44 of the separating unit 28. The link 61 is reciprocable in directions which are indicated by a double-headed arrow 62 and carries at its front end a separating element 63 in the form of a sharp-edged sword whose tip or point is movable into register with the panel 3 below the topmost stack **2*a* of the pile 1. This can be seen in FIG. 4. The parallel motion 51 for the separator 44 further supports a pressure applying wheel 64 which serves to bear upon the top sheet of the topmost stack 2*a* while the tip or point of the sword-like separating element 63 is located in the plane of the topmost panel 3 of the pile 1. The distancing means which ensures that the distance between the lowermost point of the pressure applying wheel 64 and the plane of the separating element 63 in the separator 44 equals or very closely approximates the thickness of a stack 2 includes a lever 67 which is affixed to the front portion of the link 61 by an adjusting bolt 66 or another suitable fastener. The lever 67 is pivotable relative to the link 61 at 60 and the bolt 66 can be loosened or temporarily removed in order to enable an operator to adjust the inclination of the lever 67 and hence the vertical distance of the lowermost point of the pressure applying roller 64 from the separating element 63. The directions in which the roller 64 is adjustable with reference to the plane of the separating element 63 in response to a change in the inclination of the adjustable distancing lever 67 are indicated by a double-headed arrow 68**.

The structure which is shown in FIG. 4 further comprises resilient biasing means 73 and 74 which respectively ensure that the followers 57, 58 of the links 54 and 56 remain or tend to remain in continuous contact with the faces of the respective disc cams 69, 71 on the camshaft 72. The camshaft 72 is driven cyclically by a prime mover 76 which is shown in FIG. 1. This prime mover can constitute an electric motor which is mounted on the carriage 29 for the separating units 27, 28 and serves to simultaneously drive the camshafts 72 of both separating units. To this end, the two camshafts 72 are articulately connected with the respective ends of a cardan shaft 78 which receives torque from the output element of the prime mover 76 through the medium of a toothed belt or chain transmission 77. The latter can drive the one or the other camshaft 72 in lieu of driving the cardan shaft 78. The purpose of the cardan shaft 78 is to compensate for eventual differences between the levels of the separating units 27 and 28.

The parallel motion 52 (FIG. 5) for the hold-down device 46 comprises two links 79, 81 which are pivotably mounted on the shaft 49 and carry roller followers 82, 83 which respectively track discrete disc cams 91, 92 on the camshaft 72. The links 79, 81 are articulately connected with two additional links 84 and 86. The lower end portion of the link 84 carries the hold-down device 46 and is movable with the device 46 in directions which are indicated by the double-headed arrow 68. The hold-down device 46 resembles a shoe which is insertable into the gap formed by the separating element 63 between the topmost panel 3 of a pile 1 and the stack 2 therebelow. The partially separated or lifted topmost stack is denoted by the character 2*a*.

The upper end portion of the link 84 cooperates with a photoelectronic detector 87 to form a means for monitoring the level of the separating unit 27. Signals which are generated by the monitoring means 84, 87 are used to control the movements of the motors 36, 37 for the respective separating units 27 and 28, i.e., to arrest these motors when the hold-down device 46 reaches an optimum level for penetration into the gap between the topmost panel 3 and the next-to-the-topmost stack 2 of a pile 1 at the separating station. The cams 91 and 92 further cause the parallel motion 52 of FIG. 5 to move the hold-down device 46 in directions which are indicated by the double-headed arrow 62. The purpose of the hold-down device 46 is to bear upon the topmost sheet of the stack 2 therebelow during removal of the topmost stack 2*a* by the pusher 47.

Figure 5:
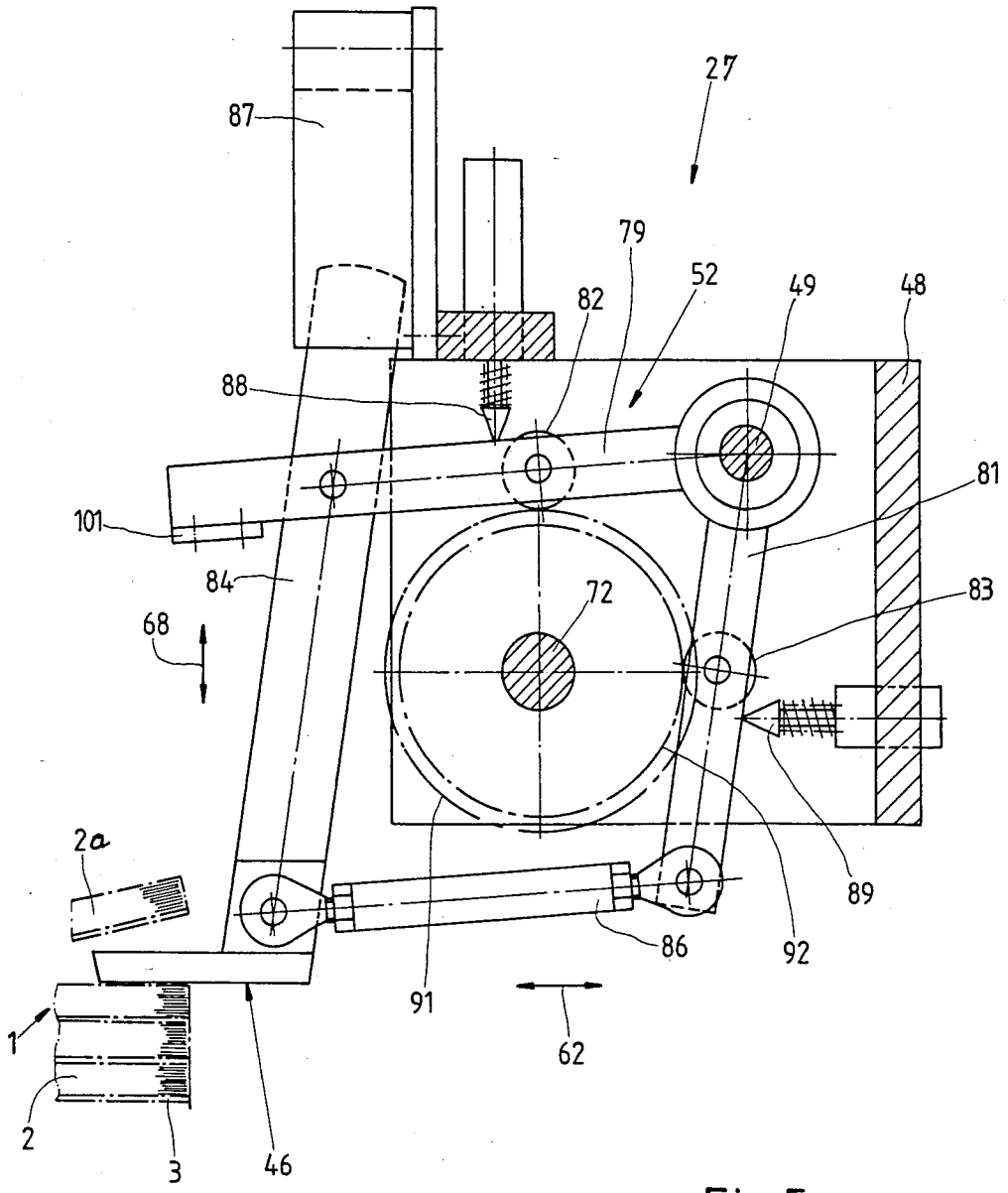
FIG. 5 is a fragmentary vertical sectional view as seen in the direction of arrows from the line V of FIG. 1 and shows the hold-down device of the one separating unit in the gap between the separated topmost stack of the pile and the stack below it.
Figure 6:
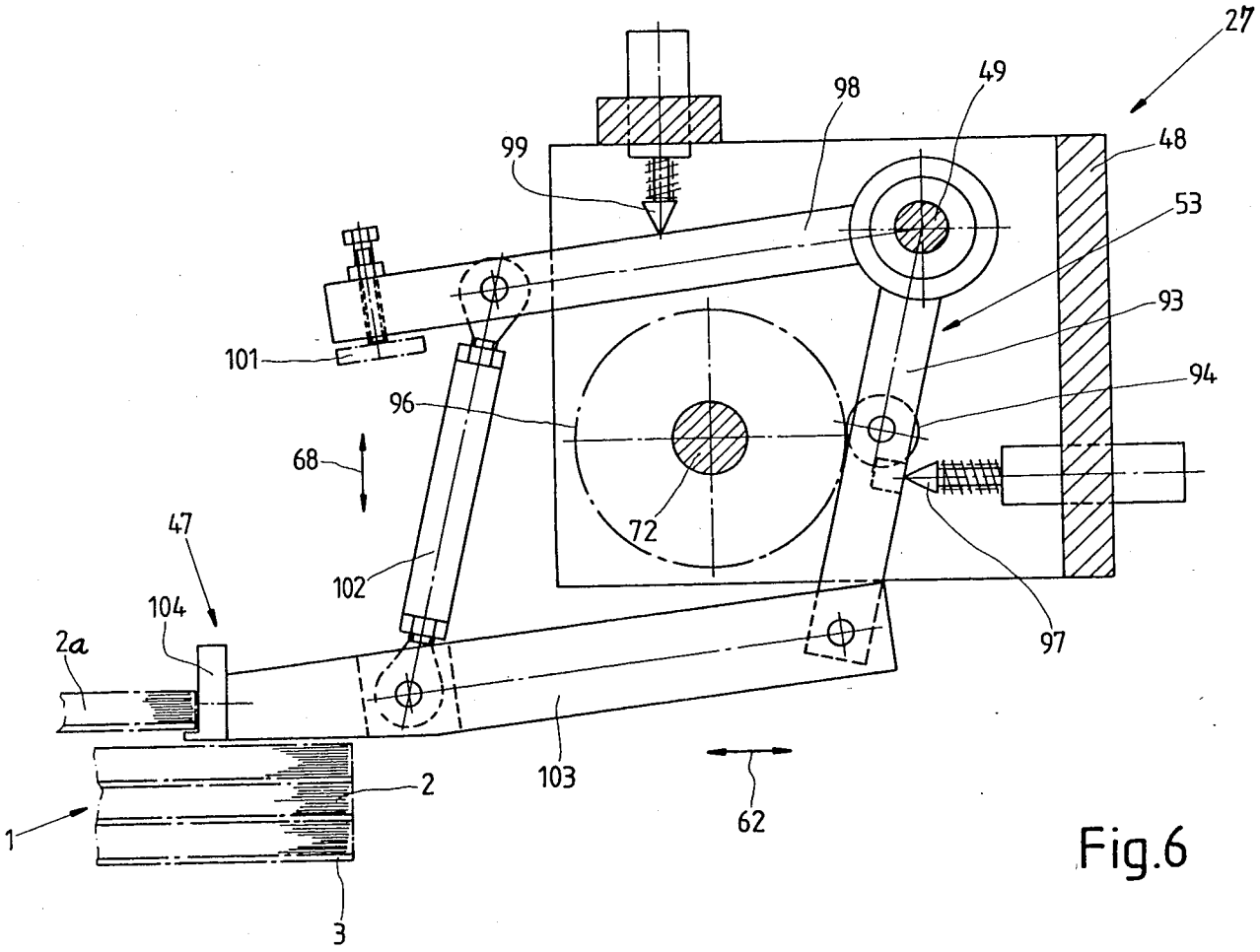
FIG. 6 is an enlarged fragmentary vertical sectional view as seen in the direction of arrows from the line VI of FIG. 1 and shows the shifting means in the process of moving the separated topmost stack in a horizontal plane and off the next-to-the-topmost stack.

The parallel motion 52 of FIG. 5 further comprises resilient means 88 and 89 for biasing the roller followers 82 and 83 against the respective disc cams 91 and 92.

The parallel motion 53 of FIG. 6 comprises a first link 93 which is pivotably mounted on the shaft 49 and carries a roller follower 94 for a disc cam 96 on the camshaft 72, and three additional links 98, 102 and 103. The front end portion of the link 103 carries a vertical strip 104 which constitutes or forms part of the pusher 47 and serves to engage the adjacent edge face of the partly separated topmost stack 2*a* and of the panel 3 therebelow for the purpose of transferring such parts of the pile 1 into a processing machine, e.g., into a machine which converts the stack 2*a* and the associated panel 3 into a plurality of exercise pads, steno pads or the like. A first resilient biasing means 97 is provided to urge the roller follower 94 against the periphery of the disc cam 96, and a second resilient biasing means 99 is provided to act upon the link 98 so as to impart to the link 98 a tendency to pivot in a counterclockwise direction (as seen in FIG. 6). The free front end portion of the link 98 is acted upon by an arm 101 of the hold-down device 46 (see also FIG. 5) which thereby urges the link 98 to pivot in a clockwise direction.

Figure 7:
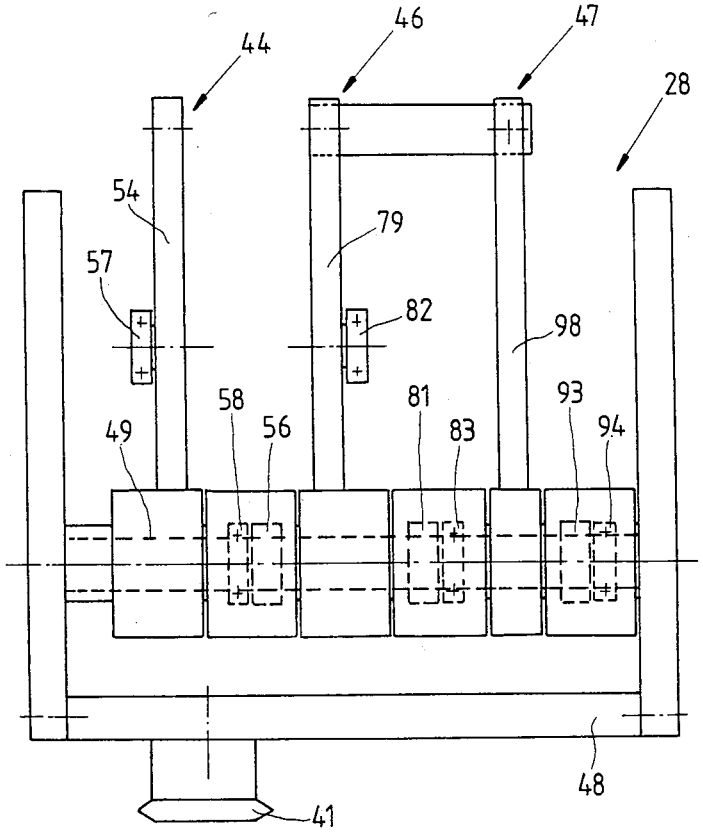
FIG. 7 is an enlarged plan view of certain details of the other separating unit.
Figure 8:
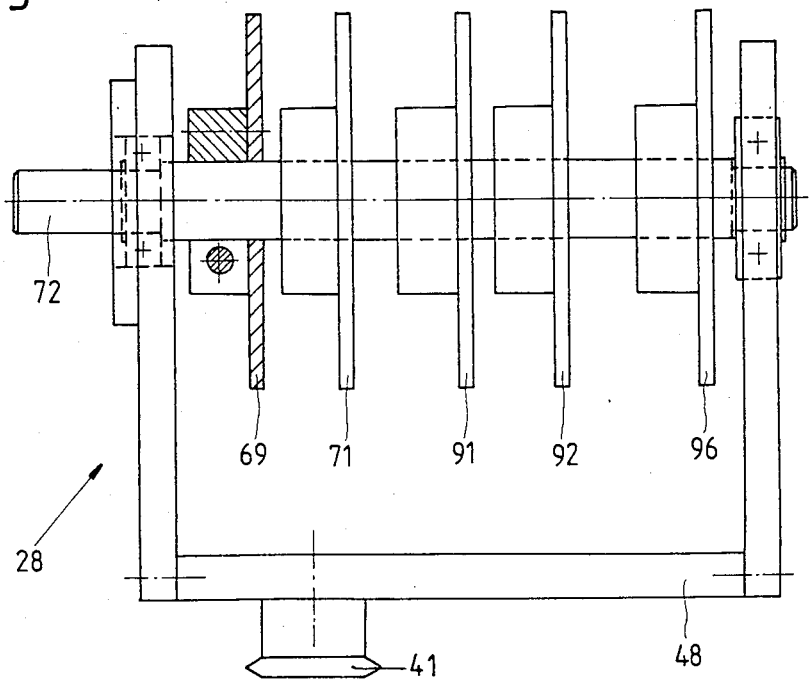
FIG. 8 is a partial plan and partial horizontal sectional view of the other separating unit.

As can be seen in FIG. 1, the separator 44 (including the pressure applying roller 64 and the separating element or sword 63), the hold-down device 46 and the pusher 47 are disposed in different planes and are movable vertically independently of each other but their movements are synchronized in a manner as will be described below. The distribution of parts 44, 46, 47 in the separating unit 28 is shown in FIG. 7, and FIG. 8 shows the distribution of disc cams 69, 71, 91, 92, 96 on the common camshaft 72 of the separating unit 28.

Figure 9:
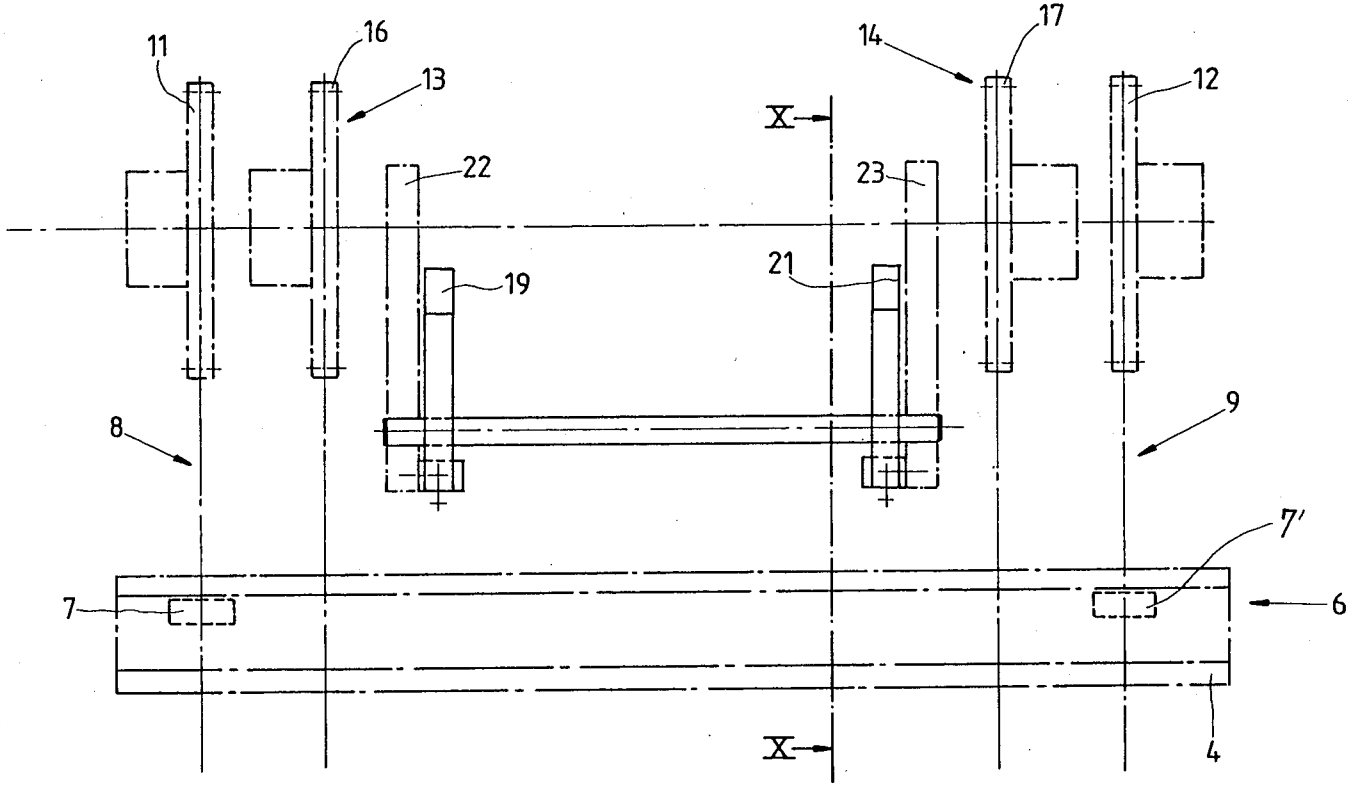
FIG. 9 is a schematic front elevational view of elevator conveyor means for pallets which support the piles of superimposed stacks and lift the piles upon removal of successive stacks therefrom.
Figure 10:
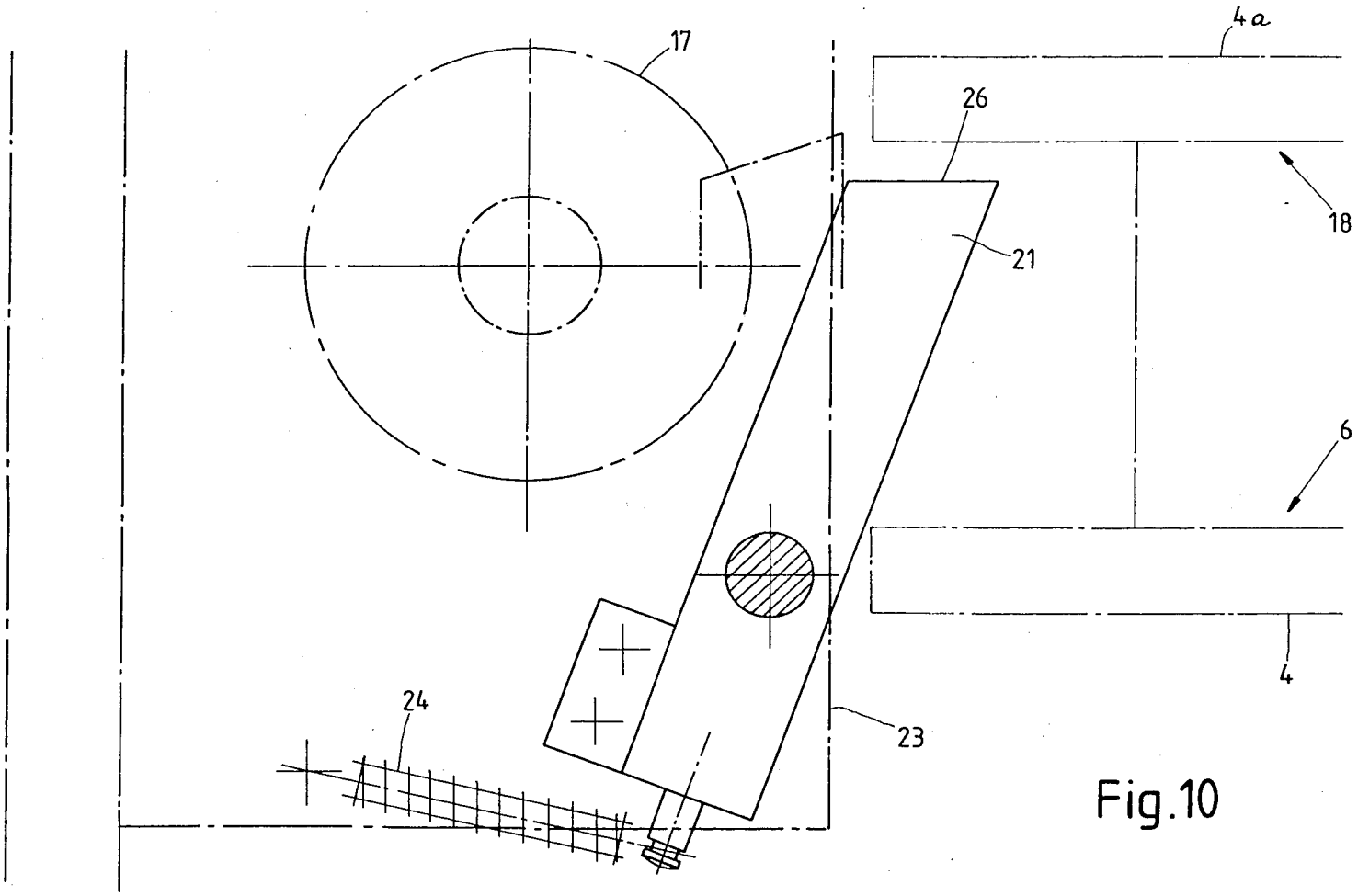
FIG. 10 is an enlarged fragmentary vertical sectional view as seen in the direction of arrows from the line X—X of FIG. 9.

The mode of operation of the apparatus which is shown in FIGS. 1 to 10 is as follows:

It is assumed that a fresh pallet 4 with an intact pile 1 of stacks 2 and panels 3 has been delivered to the lower station 6 of FIGS. 1, 9 and 10. The motors 36 and 37 are thereupon started to move the respective separating units 27, 28 downwardly to a level at which the hold-down devices 46 come to rest on the topmost sheet of the topmost stack 2*a* of the pile 1 on the freshly delivered pallet 4. The motors 36 and 37 continue to move the respective separating units 27 and 28 in a downward direction while the hold-down devices 46 assume the extended positions of FIG. 5 so that the devices 46 continue to engage the topmost sheet of the topmost stack 2*a* and the resilient biasing means 88 yield in order to enable the roller followers 82 on their links 79 to rise above and away from the respective disc cams 91. Therefore, the upper end portions of the links 84 rise into the range of the respective photoelectronic detectors 87 so that the monitoring means generate signals which are used to arrest the respective motors 36 and 37.

The lobes of the disc cams 69, 71, 91, 92 and 96 have been omitted in all Figures for the sake of simplicity. When the hold-down devices 46 come to rest on the topmost sheet of the topmost stack 2*a* of the pile 1, the camshaft 72 (which is driven to synchronize the movements of various components of each of the two separating units) causes the cams 92 to shift the respective roller followers 83 on the links 81 so that the hold-down devices 46 are retracted in a direction to the right, as seen in FIG. 5, beyond the front edge face of the pile 1.

The just described steps are followed by the step of partially separating the topmost stack 2*a* and the adjacent panel 3 from the remaining stacks 2 and panels 3 of the pile 1 on the pallet 4. The camshaft 72 causes the cams 69 and 71 to lower the pressure applying rollers 64 of the separators 44 into contact with the topmost sheet of the topmost stack 2*a* whereby the separating elements 63 come to rest at the level of the topmost panel 3 of the pile 1. The rollers 64 bear upon the topmost stack 2*a* with a selected force so that the thickness of the topmost stack 2*a* is reduced, if necessary, to that which is required to enable the separating elements 63 to reach the level of the topmost panel 3. As mentioned above, the adjusting means 66 can be actuated before the apparatus is put to use to ensure that the distance between the level of the lowermost portion of a roller 64 and the plane of the respective separating element 63 will equal or closely approximate the height or thickness of a properly densified stack 2*a*. The arrangement is such that, when a roller 64 rests on the topmost sheet of the properly compressed or condensed stack 2a, the tip or point of the respective separating element 63 aims exactly at the adjacent edge face of the panel 3.

The cams 69 and 71 thereupon cause the parallel motion 51 of FIG. 4 to move the link 61 in a direction to the left so that the tip of the separating element 63 penetrates into the aligned panel 3 under the action of the resilient biasing means 74 which maintains the roller follower 58 in contact with the cam 71. In the next step, the parallel motion 51 of FIG. 4 causes the link 61 to raise the separating element 63 and the roller 64 so that the topmost stack 2a and the adjacent panel 3 become partly separated from the next-to-the-topmost stack 2 (see FIG. 5). The parallel motion 52 thereupon causes the hold-down device 46 to penetrate into the gap between the lifted stack 2a and panel 3 on the one hand and the topmost stack 2 of the remainder of the pile 1 on the other hand, and the hold-down device 46 bears against the topmost sheet of the stack 2 therebelow.

The next step involves the shifting of the lifted stack 2 and the associated panel 3 in a direction to the left, as seen in FIG. 6, under the action of the pusher 47 which receives the necessary movement from the parallel motion 53. The pusher 47 is designed to advance the lifted stack 2a and the associated panel 3 into the range of grippers (e.g., jaws) of tongs or other suitable means for introducing the separated stack into an automatic processing machine, e.g., into the aforementioned machine which converts the stacks 2a and the associated panels 3 into pads, books or the like.

The pusher 47 is retracted by the parallel motion 53 in the next-following step and is simultaneously acted upon by the arm 101 of the hold-down device 46 so that it is lifted off the upper side of the topmost sheet of the uppermost stack 2 of the remainder of the pile 1.

Figure 11:
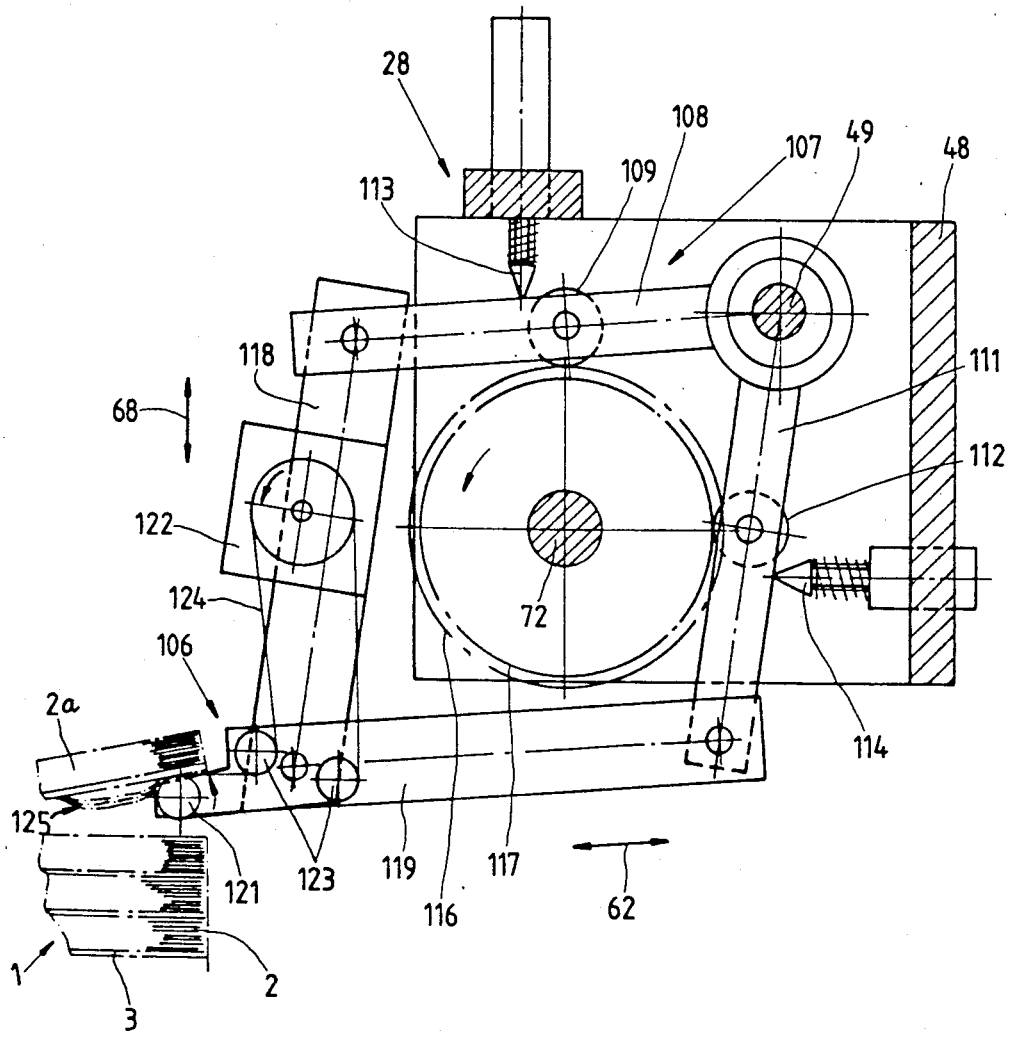
FIG. 11 is vertical sectional view similar to that of FIG. 4 but showing a modified separating unit which is provided with means for stripping surplus sheets off the underside of a freshly separated panel.

If the apparatus is to be operated in such a way that the separating element 63 should penetrate into the pile 1 at a level slightly below the topmost panel 3 (e.g., at a distance of one or two millimeters from the plane of the topmost panel 3), the separating units 27 and 28 are modified in a manner as shown in FIG. 11. Thus, each of the separating units then further comprises an additional parallel motion 107 which is mounted on the respective shaft 49 and receives motion from the camshaft 72 in the frame 48 through the medium of disc cams 116 and 117. The parallel motion 107 comprises two links 108, 111 which respectively carry roller followers 109, 112 for the cams 116, 117. The links 108, 111 are pivotably mounted on the shaft 49 and cooperate with two additional links 118, 119 of the parallel motion 107, and the roller followers 109, 112 are urged against the respective cams 116, 117 by resilient biasing means 113, 114, respectively. The front end portion of the link 119 carries a sheet stripping or peeling device 106 which comprises a friction roller or wheel 121. The latter is continuously driven by a small electric or other suitable motor 122 on the link 118 through the medium of a belt 124 which is trained over a pulley on the output element of the motor 122 and over additional pulleys 123 on the link 119.

The mode of operation of the separating unit 28 which is shown in FIG. 11 is as follows: When the tip of the separating element 63 (not shown in FIG. 11) penetrates into the pile 1 at a level slightly below the topmost panel 3, a certain number of sheets 125 belonging to the next-to-the-topmost stack 2 will be lifted with the topmost stack 2a and the adjacent panel 3. The continuously driven friction wheel 121 penetrates into the gap beneath the sheets 125 and automatically peels or strips such sheets off the underside of the lifted panel 3 because it is rotated in a counterclockwise direction, as seen in FIG. 11.

The next-following steps correspond to those which are carried out with the separating units 27 and 28 of FIGS. 1 to 10, i.e., the separation of surplus sheets 125 from the underside of the lifted panel 3 is followed by advancement of the hold-down device 46 to its operative position and thereupon by actuation of the pusher 47 which removes the lifted stack 2a and the associated panel 3 and advances them into the range of the aforementioned gripper means.

Figure 12:
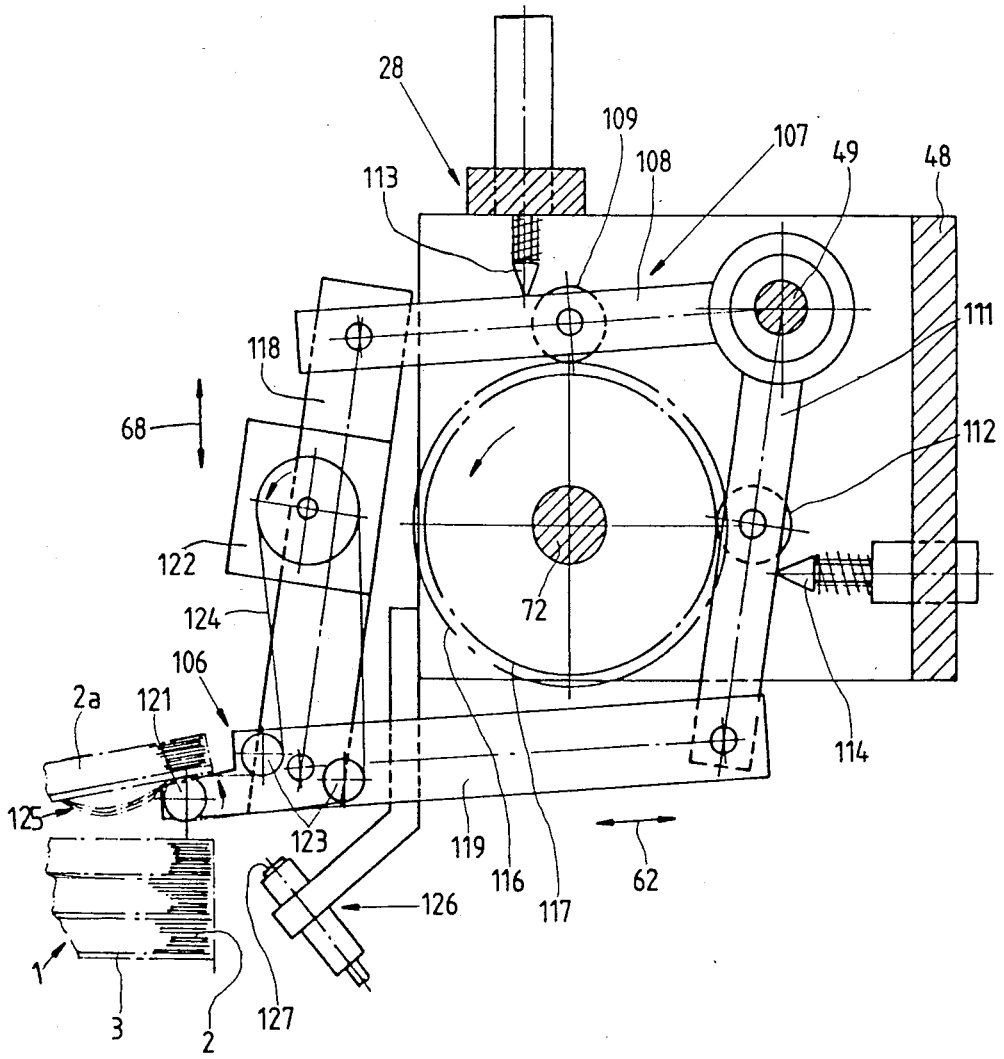
FIG. 12 is a similar sectional view of a further separating unit.

FIG. 12 shows the structure of FIG. 11 and a second monitoring device 126 which cooperates with the separator 44 of the respective separating unit 27 or 28 (only the unit 28 is shown in FIG. 12). The monitoring device 126 can comprise a photoelectronic detector 127 which scans the adjacent portion of the pile 1 to determine the presence or absence of a panel 3 above the sheets 125 which are to be separated from the underside of the adjacent panel 3 before the panel and the stack 2a thereabove are transferred into the processing machine. Signals which are generated by the detector 127 can be used to segregate a lifted stack 2a which does not rest on a panel 3 and to enable the pusher 47 to transfer the freshly lifted stack 2a and the associated panel 3 if the detector 127 detects the presence of such panel. The means for segregating a defective stack 2a (i.e., a stack which does not rest on a panel 3) can include the pusher 47 or a discrete separating or expelling device, not shown.

If the apparatus is to be designed to simultaneously lift two or more stacks 2 and a corresponding number of panels 3, the distance between the pressure applying roller 64 and the separating element 63 in each of the separating units 27, 28 is selected accordingly. The average thickness or height of a stack 2 is known in advance so that the distance from the roller 64 to the corresponding separating element 63 in each separator 44 can be readily selected in advance with a required degree of accuracy. It is also possible to accurately select the force with which the roller 64 bears upon the topmost sheet of the topmost stack 2a; this also contributes to reliability and reproducibility of the separating operation which can be carried out with the improved apparatus.

As shown in FIG. 7, various components of a separating unit (28) are movable relative to each other in discrete vertical planes and such components can be moved substantially horizontally (arrow 62) or substantially vertically (arrow 68), depending upon the functions of the respective components.

The embodiment of FIGS. 11 and 12 (wherein the separating element 63 penetrates into the pile 1 below the topmost panel 3 will be put to use if the operators do not wish the tip of the element 63 to penetrate into the edge face of the topmost panel 3.

The hold-down devices 46 constitute optional components of the improved separating units. Their purpose is to ensure that the topmost sheet or sheets of the stack 2 beneath the partially lifted topmost panel 3 will not be shifted sideways in response to entrainment of the topmost panel 3 and the stack 2a thereabove by the respective pusher 47, i.e., that the shape of the stack 2 below the panel 3 which is in the process of moving sideways is not adversely affected by such movement of the panel 3 above it.

It is not always necessary to assemble the separators 44, the hold-down devices 46, the pushers 47 and the friction wheels 121 into discrete separating units (such as the units 27 and 28). However, the provision of such units is preferred at this time because the parallel motions for all of their components can be mounted on a common support (shaft 49) and can receive motion from a common driving element (camshaft 72). This contributes to simplicity, compactness and lower cost of the apparatus.

The apparatus can employ a single separating unit or three o more separating units without departing from the spirit of the invention. The cardan shaft 78 is a desirable and often necessary component of the apparatus because it enables the elements 63 of the two separating units 27, 28 to be disposed at different levels during penetration into the front edge face of one and the same panels 3 even if the panel is not entirely flat, e.g., if the panel (especially a large or very large panel) happens to assume an undulate shape.

An important advantage of the improved apparatus is that it can be readily adjusted and operated in such a way that it invariably removes a single stack (*2a*) and a single panel (3) regardless of whether the pile 1 is still intact or whether it height has been reduced by the height of one or more stacks. Moreover, the apparatus can remove discrete stacks and panels at a high frequency such as is necessary to satisfy the requirements of a high-speed pad making or other machine, and the removal of stacks and associated panels is carried out in a fully automatic way.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for subdividing a pile of superimposed stacks of sheets wherein each stack has a predetermined thickness and rests on a planar bottom panel of paperboard or the like, comprising separating means including at least one separating unit having a device for applying to the pile mechanical pressure from above, a separating element disposed in a plane which is parallel to the planes of bottom panels in the pile and is arranged to penetrate into the pile at a level below said device, distancing means for maintaining said device and said separating element in spaced-apart positions at at a mutual distance at least matching said predetermined thickness, and means for moving said device in a substantially vertical plane toward engagement with the topmost stack of the pile and for moving said separating element in a substantially horizontal plane penetrating into the panel beneath the topmost stack of the pile.

2. The apparatus of claim 1, further comprising means for adjusting said distancing means so as to vary the distance between said device and said separating element.

3. The apparatus of claim 1, wherein said distancing means includes means for maintaining said separating element in the plane of the panel beneath the topmost stack of the pile when said device abuts the topmost sheet of the topmost stack.

4. The apparatus of claim 1, wherein said separating element is arranged to form a gap between the topmost panel of the pile and the stack therebelow and said separating unit further comprises a hold-down deice and means for moving said hold-down device into said gap and against the topmost sheet of the next-to-the-uppermost stack of the pile upon penetration of said separating element into the pile beneath said device.

5. The apparatus of claim 1, wherein said separating unit further comprises means for shifting the separated topmost stack of the pile and the panel beneath the topmost stack with reference to the next-to-the-uppermost stack of the pile.

6. The apparatus of claim 1, wherein said pressure applying device includes at least one roller or wheel.

7. The apparatus of claim 1, wherein said separating element includes a sharp-edged sword.

8. The apparatus of claim 1, further comprising means for supporting the pile and for lifting the pile upon removal of a stack and a panel therefrom.

9. Apparatus for subdividing a pile of superimposed stacks of sheets wherein each stack has a predetermined thickness and rests on a planar bottom panel of paperboard or the like, comprising separating means including at least one separating unit having a device for applying to the pile mechanical pressure from above, a separating element disposed in a plane which is parallel to the planes of bottom panels in the pile and is arranged to penetrate into the pile at a level below said device, distancing means for maintaining said device and said separating element in spaced-apart positions at a mutual distance at least matching said predetermined thickness, and means for stripping surplus sheets off the underside of the panel beneath the topmost stack of the pile if and when said separating element penetrates into the pile beneath the panel which is disposed immediately below the topmost stack of the pile.

10. The apparatus of claim 9, wherein said stripping means includes a driven friction wheel.

11. Apparatus for subdividing a pile of superimposed stacks of sheets wherein each stack has a predetermined thickness and rests on a planar bottom panel of paper board or the like, comprising separating means including at least one separating unit having a device for applying to the pile mechanical pressure from above, a separating element disposed in a plane which is parallel to the planes of bottom panels in the pile and is arranged to penetrate into the pile at a level below said device, distancing means for maintaining said device and said separating element in spaced-apart positions at a mutual distance at least matching said predetermined thickness, means for shifting the separated topmost stack of the pile and the panel beneath the topmost stack with reference to the next-to-the-uppermost stack of the pile, a hold-down device movable against the topmost sheet of the next-to-the-uppermost stack of the pile upon penetration of said separating element into the pile beneath the topmost stack, means for moving said pressure applying device and said separating element, means for moving said shifting means, for moving said hold-down device, and a common support for said moving means.

12. The apparatus of claim 11, wherein each of said moving means comprises a parallel motion and said support comprises a common shaft for said parallel motions.

13. The apparatus of claim 12, wherein said unit further comprises means for stripping surplus sheets off the underside of the panel beneath the topmost stack of the pile if and when said separating element penetrates into the pile beneath the panel which is disposed below the topmost stack, and a parallel motion for moving said stripping means relative to the pile, the parallel motion for moving said stripping means being mounted on said support.

14. The apparatus of claim 13, further comprising drive means for said parallel motions including a rotary camshaft, a plurality of cams provided on said camshaft, and follower means provided on said parallel motions and each tracking one of said cams.

15. Apparatus for subdividing a pile of superimposed stacks of sheets wherein each stack has a predetermined thickness and rests on a planar bottom panel of paper board or the like, comprising separating means including a plurality of separating units which are spaced apart from one another and each of which has a device for applying to the pile mechanical pressure from above, a separating element disposed in a plane which is parallel to the planes of bottom panels in the pile and is arranged to penetrate into the pile at a level below the respective device, and distancing means for maintaining the respective device and the respective separating element in space-apart positions at a mutual distance at least matching said predetermined thickness; and means for moving said pressure applying devices and said separating elements of said units up and down, including a discrete rotary driver shaft of each of said units, a cardan shaft connecting said driver shafts, and a prime mover arranged to rotate one of said shafts.

16. The apparatus of claim 15, further comprising a common reciprocable carriage for said units.

17. The apparatus of claim 15, wherein each of said units further comprises a hold-down device and means for moving the hold-down device against the topmost sheet of the next-to-the-topmost stack of the pile upon penetration of the respective separating element into the pile beneath the respective pressure applying device, said means for moving said hold-down devices including parallel mechanisms and further comprising signal generating means for monitoring the levels of said units, said monitoring means being provided on or associated with at least one of said means for moving said hold-down devices.

18. The apparatus of claim 17, further comprising means for arresting the means for moving said units up and down in response to signals from said monitoring means.

* * * * *